United States Patent [19]

Richard

[11] 4,433,525

[45] Feb. 28, 1984

[54] METHOD AND A DEVICE FOR EXTENDING THE DECK OF A BRIDGE OR SIMILAR STRUCTURES, WITH DESK SEGMENTS, USING A CABLE STAYED BEAM

[75] Inventor: Pierre Richard, Neuilly sur Seine, France

[73] Assignee: Bouygues, Clamart, France

[21] Appl. No.: 324,016

[22] Filed: Nov. 23, 1981

[30] Foreign Application Priority Data

Nov. 25, 1980 [FR] France ..... 80 24985

[51] Int. Cl.[3] ..... E04G 21/00; E01D 21/04

[52] U.S. Cl. ..... 52/741; 52/174; 52/745

[58] Field of Search ..... 14/1; 52/745, 174, 741

[56] References Cited

U.S. PATENT DOCUMENTS 2,963,764 12/1960 Finsterwalder ..... 52/174 X

FOREIGN PATENT DOCUMENTS 2703822 8/1978 Fed. Rep. of Germany ..... 52/745
2718616 11/1978 Fed. Rep. of Germany ..... 52/174
553706 2/1923 France ..... 52/174
594237 2/1978 U.S.S.R. ..... 14/1

*Primary Examiner*—Alfred C. Perham
*Attorney, Agent, or Firm*—McCormick, Paulding & Huber

[57] ABSTRACT

This disclosure relates to the extension of a portion of a deck using deck segments, by means of a cable stayed beam resting on a front hinged support and on a rear support.

In a first phase, the overhanging segments are suspended from the beam in a manner known per se and the part 5*a* of the beam which is downstream of the front support 6 is maintained substantially steady. In a second phase, the segments are joined to said portion by producing a prestress accompanied by a progressive swinging movement by said rear part of the beam.

This invention is used for the construction of the deck of a bridge.

8 Claims, 8 Drawing Figures

METHOD AND A DEVICE FOR EXTENDING THE DECK OF A BRIDGE OR SIMILAR STRUCTURES, WITH DESK SEGMENTS, USING A CABLE STAYED BEAM

This invention relates to the positioning of segments using a cable stayed beam, for building a bridge or similar structures such as the roof or the floor of a building.

The term "segment" (in French "voussoirs") is to be considered in this application as designating a portion of the length of the deck, which is to be assembled end to end with other similar segments to gradually build the deck.

The invention will be described with respect to the extension of the deck of a bridge.

A so-called "overhung positioning" method is known for positioning segments in the extension of a portion of the floor of a bridge using a cable stayed beam which rests on a rear support and on a hinged front support.

Known methods of this type generally only allow one or two segments to be positioned at the same time, because the simultaneous positioning of several segments by known methods would require a progressive transfer of the load of segments from the beam to the floor which is not permitted by the known methods.

An object of the present invention is to improve a method of this type so that it is possible to progressively pass the load of several segments from the beam to the deck at the same time as the application of the corresponding prestress.

This object is achieved according to the present invention by a method which comprises a first phase, during which the overhanging segments are suspended from said beam and the part of the beam which is behind the front support is maintained substantially steady, and comprises a second phase during which the segments are joined to the said portion while producing a prestress in the segments and in said portion, and the weight of the segments is progressively transferred to the said portion substantially simultaneously with the application of the prestress, this being obtained while progressively allowing said rear part of the beam to swing around the front support during the said second phase.

Typically, the beam between its state preceding being loaded with the segments and the final state after the complete transfer of the load to the floor has only undergone one complete swinging movement around the front support.

A method according to the present invention will now be described in the following, using a device which is also typical of the present invention, while referring to the Figures of the drawing.

Figure 1:
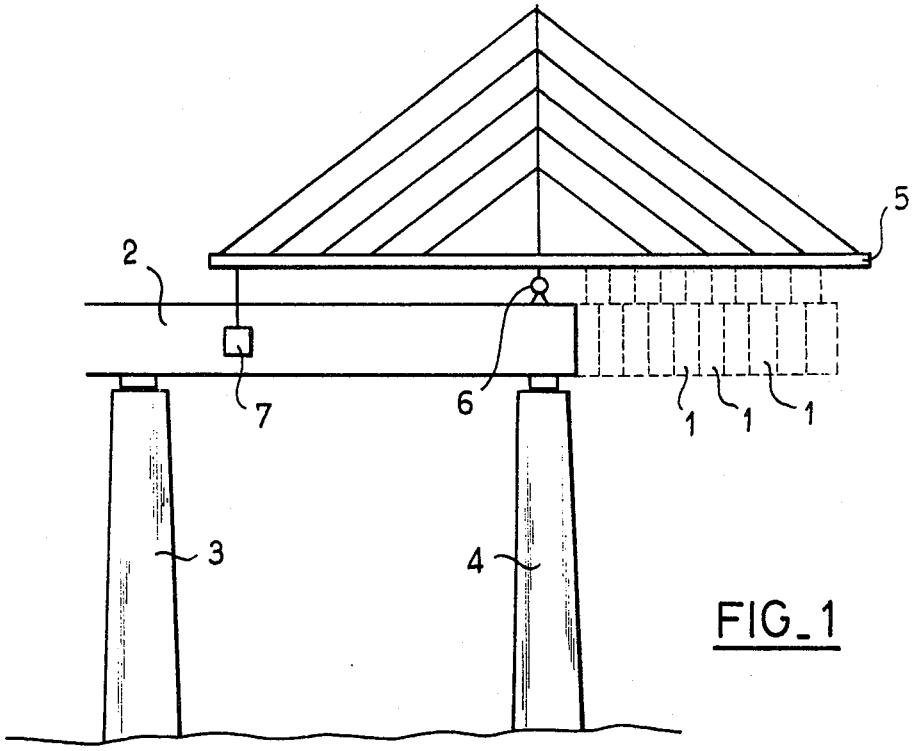
FIG. 1 is a longitudinal diagram of a bridge during the construction of a bay using successive segments and by means of a positioning beam.
Figure 8:
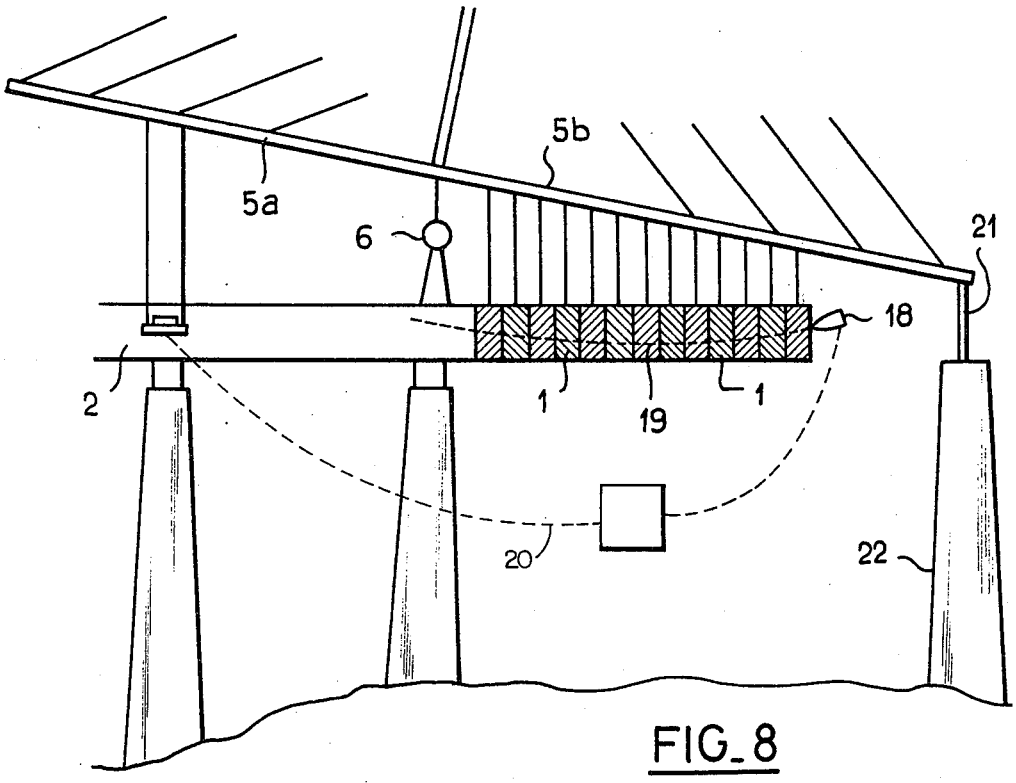
FIG. 8 is a diagram of an auxiliary device which may be used for positioning additional deck segments.

It is assumed (FIG. 1) that segments 1 are to be positioned in the extension of a portion of deck 2 which has already been constructed, in order to produce the bay of a bridge. The portion 2 rests, for example, on supports represented by piers 3 and 4.

A cable stayed beam 5 is positioned in a manner known per se so that it rests on two supports, that is, on a front support 6 and on a rear support 7. These two supports are generally supports on the deck, but, in a variation, they may be supports independent of the deck, for example, supports on the piers or on natural solid masses.

The front support 6 is hinged so that the beam may swing on this support.

Means, for example, trucks, may slide along the beam to move the segments 1 into their final position. The segments are suspended from these means by cables.

It is unnecessary to describe these devices in more detail, since they are well known to the skilled man and have only been mentioned above to clarify the description.

Figure 2:
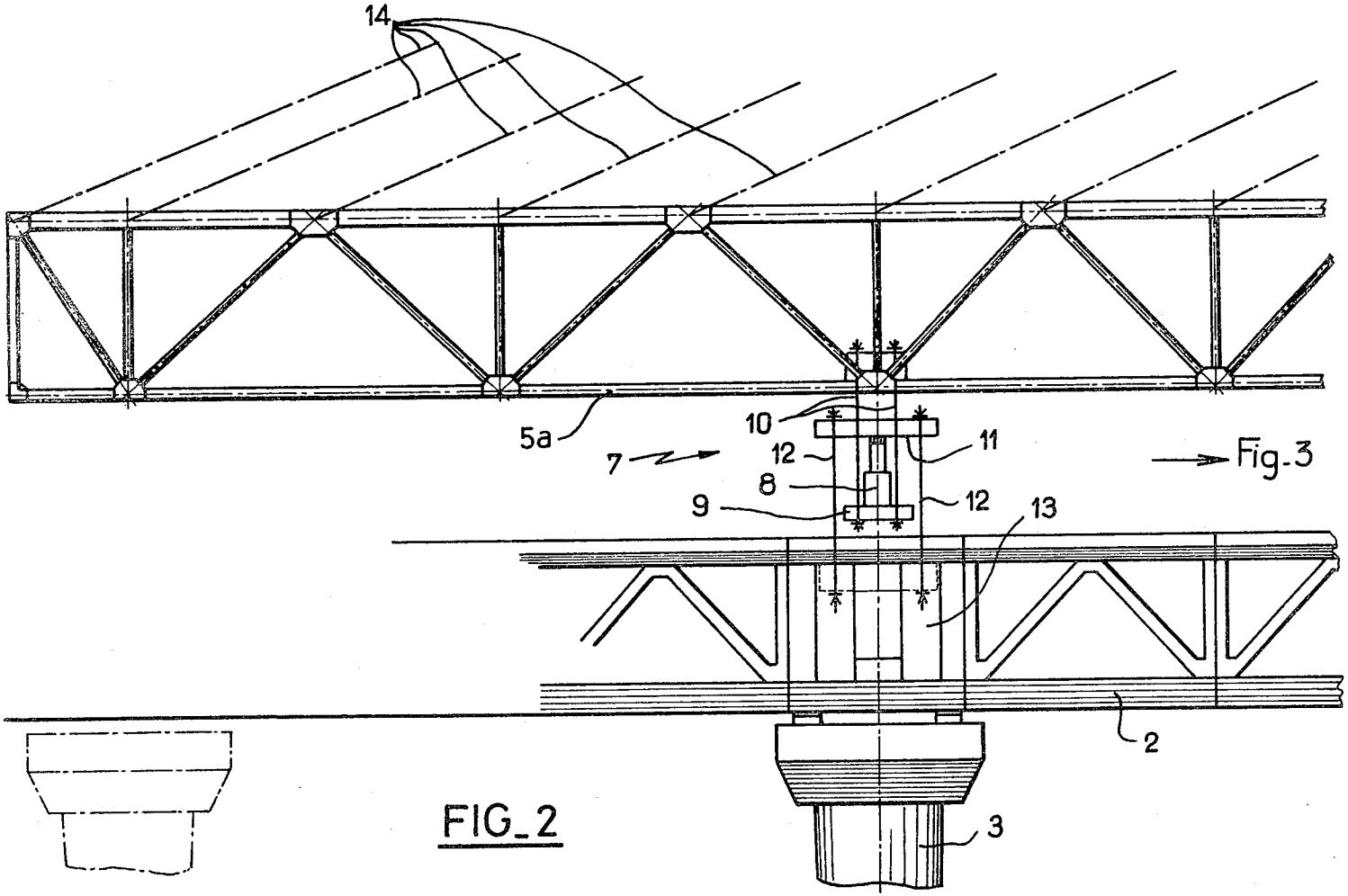
FIGS. 2 to 5 are sections of a longitudinal view of the bridge during the construction of the bay at different points along the length of the positioning beam which is used for this construction.
Figure 3:
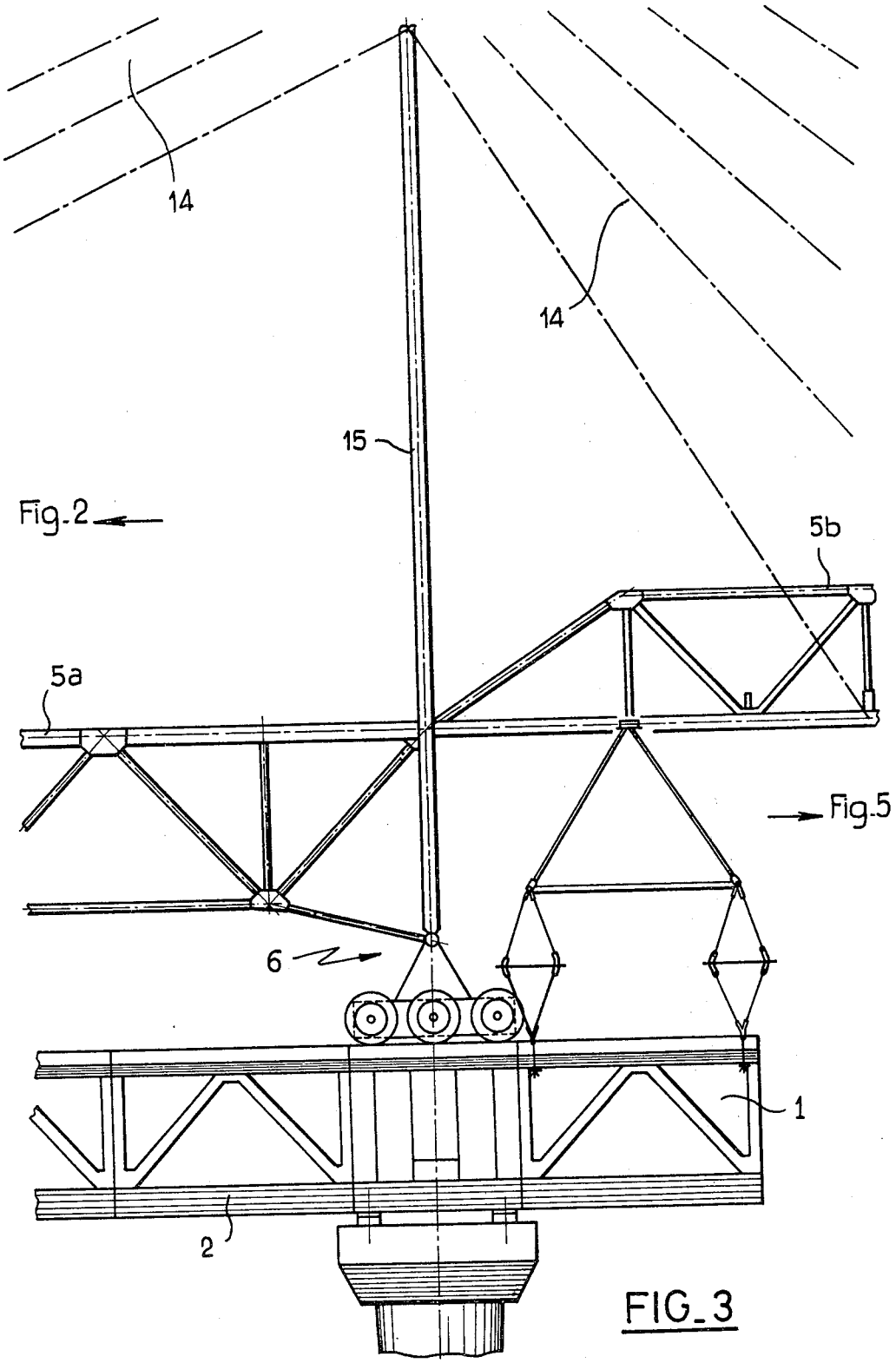
Figure 4:
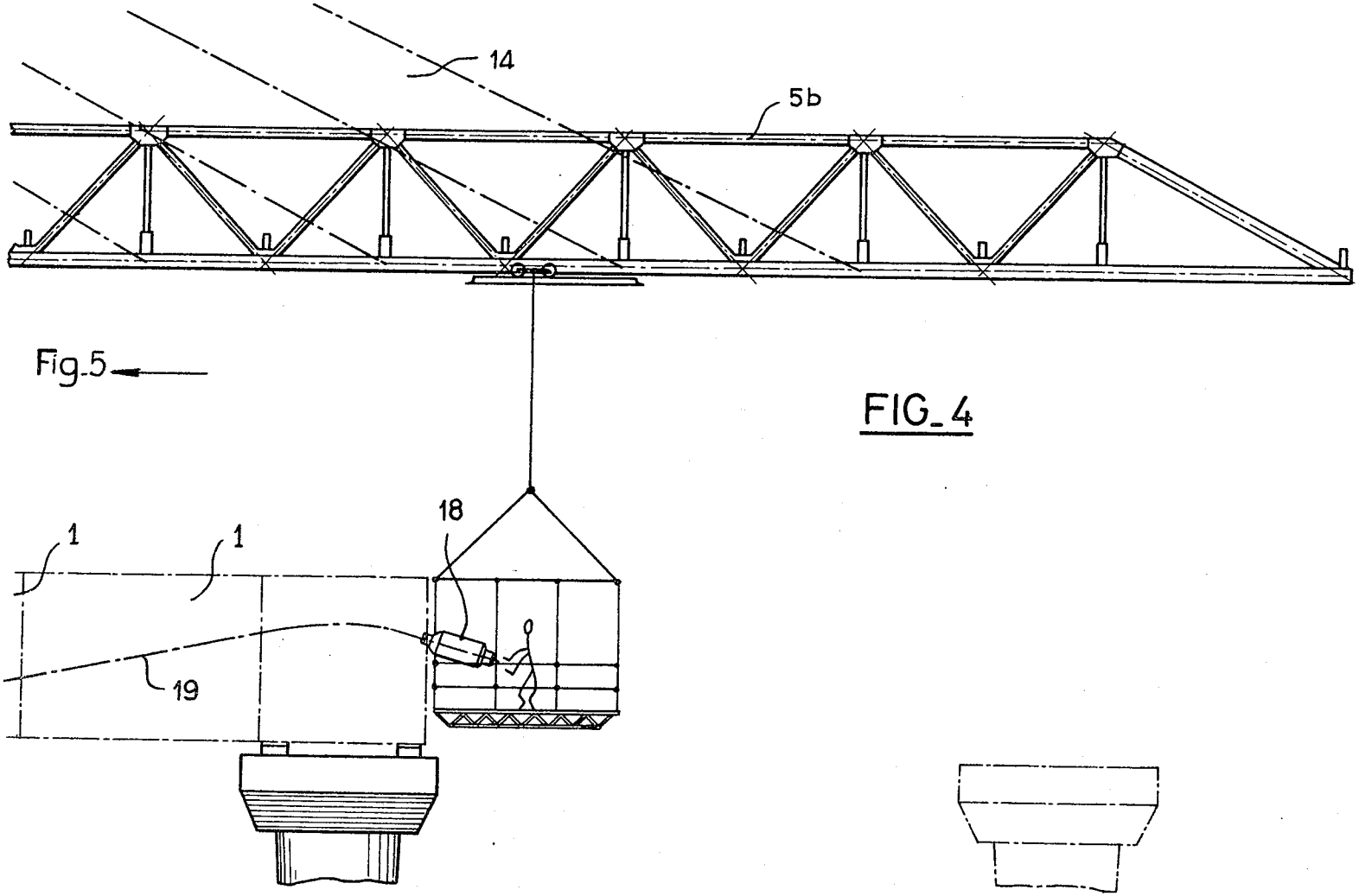
Figure 5:
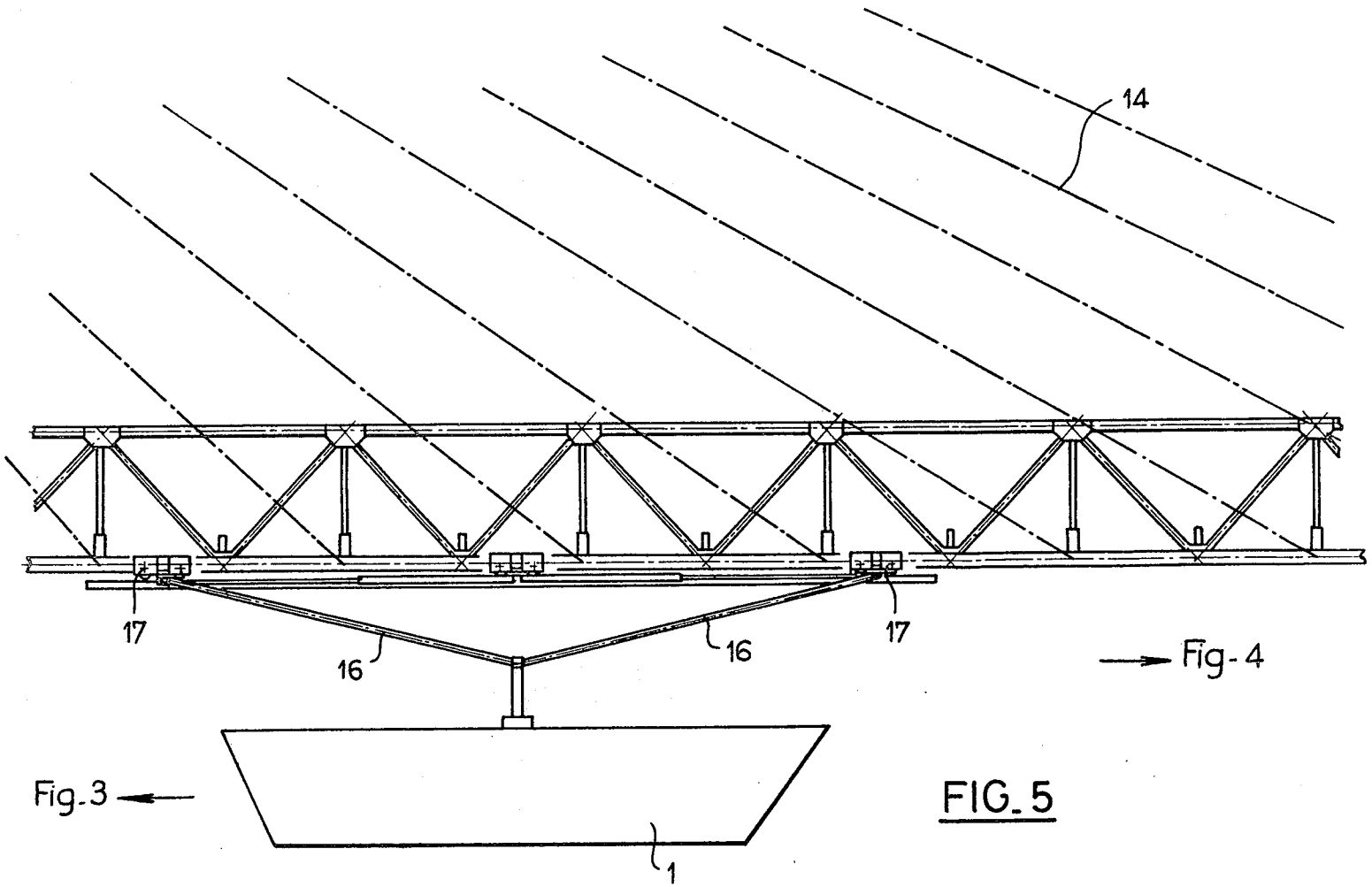

FIGS. 2 to 5 are different longitudinal views of an embodiment according to the present invention. FIG. 2 illustrates the region of the rear support 7. FIGS. 3 and 4 illustrate respectively the region of the front hinged support and the region of the front end of the beam. FIG. 5 is a view of a region of the beam at some stage between that of FIG. 5 and that of FIG. 4 where a segment 1 is suspended.

In FIGS. 2 to 8, the part of the beam 5 which is behind the hinged support 6 is designated with reference numeral 5*a* and the part in front of the support 6 is designated with reference numeral 5*b*.

According to the present invention, the rear support 7 is designed so that, during the loading of the beam with the segments, the support is capable of maintaining immobile the part of the beam which is downstream of the hinged support 6 and is also designed so that it may allow this rear part to swing as the segments 1 are joined by the prestress and form a beam which itself becomes part of the deck, which ensures the transfer of the individual weight of the segments to the new structure composed of the deck 2 and of the extension thereof.

In a preferred embodiment, this rear support 7 is formed by means of a jack or by an assembly of jacks which act to operate a controlled swinging movement of the rear part of the deck during the transfer phase of the weight of the segments to the deck.

FIG. 2 illustrates, for example, an embodiment of the rear support while assuming that in this case, the support comprises a single jack 8.

The cylinder of the jack 8 is supported by a bearing 9 which is suspended from the rear part 5*a* of the beam by suspending rods 10, and the shank of the jack 8 is pressed against a plate 11 connected by cables 12 to a solid mass 13 which is positioned opposite the pier 3.

The rear part of the braces 14 of the beam may be seen in FIG. 2. The centre part and the pole 15 may partly be seen in FIG. 3, whereas the front part of the braces may be seen in FIGS. 4 and 5.

Figure 6:
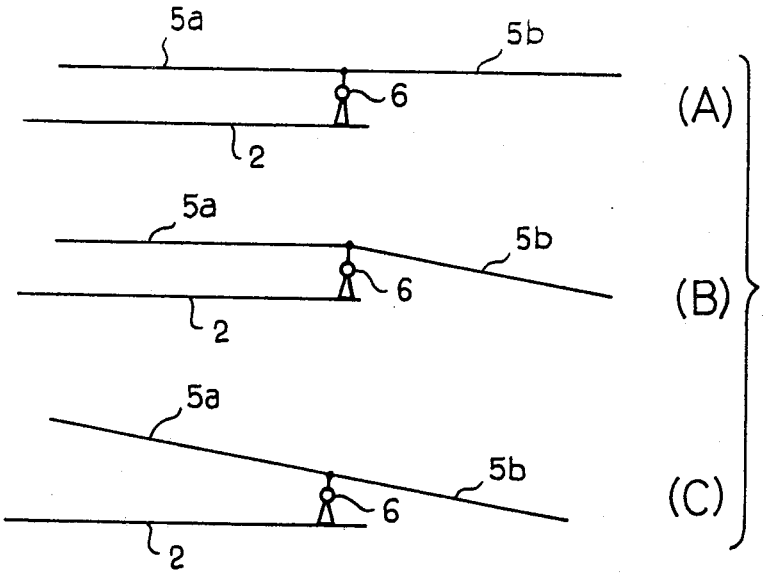
FIG. 6 is an outline diagram of the configuration of the positioning beam at different times of the construction of the cross piece (omitting the pole and braces)

It is assumed for simplification purposes, that before loading with the segments, the beam is horizontal, as shown in FIG. 6 (A).

The segments to be positioned are suspended in a known manner from trucks mounted for sliding on the beam and the trucks are moved along the beam until the segments are in a position which has been allocated to them in the extension of the floor. FIG. 5 illustrates a segment 1 in the course of being moved. It is suspended from trucks 17 by cables 16. The segment will possibly have to be pivoted about 90°, as in the case illustrated, in order to be brought into the operating position (as illustrated in FIG. 3).

A plurality of segments are thus advanced to part 5*b* of the beam where they are positioned in tandem.

Under the effect of the weight of the segments, the front part of the beam takes on a considerable vertical deformation, none at the level of the articulation 6, maximum at the end of the overhanging end of the beam. The rear support 7 which is immobilized maintains immobile the rear part 5*a* of the beam. This is simplified in FIG. 6 (B).

It will be seen that the deformation of the beam is caused by the traction of the cables, then by the extension thereof. In the operation of the beam, the rear support is under traction. It balances the tipping action of the beam caused by the overhanging segments. The bracing is dimensioned such that under the action of the load caused by the segments, the vertical deformation of the front part of the beam is substantially linear. Finally, it should be noted that the vertical deformations of the front part of the beam are very considerable with respect to the deformations, on the one hand, of the cables connecting the beam to the segments and, on the other hand, of the deck itself under the combined action of its own weight and of the joining prestress.

After a levelling adjustment of the segments and after a slight prejoining tightening, the joining operation to the deck which has already been constructed is commenced by prestressing the segments.

FIG. 4 simplifies all of the prestressing jacks by one jack 18 which pulls a prestressing cable 19 across the segments illustrated in dash-dotted lines.

According to the present invention, a monitoring system (automatic or manual) is produced between the jack(s) of the rear support of the beam and the prestressing jack(s). This monitoring system is simplified in FIG. 8 by a broken line 20.

Before the prestressing cables are tensioned, the jack of the rear support is loaded and the tensioning jack of the prestressing cables is not loaded. Due to the monitoring system between these two jacks, in proportion to the tensioning of the cables, the jack of the rear support of the beam goes down. Thus, this operation automatically allows the transport of the load of the inherent weight of the deck into the deck itself in proportion to the tensioning of the prestressing cables. A progressive detensioning of the cables of the cable stayed beam is observed. The front 5*b* of the beam remains practically immobile, whereas the rear 5*a* thereof swings upwards until it substantially alignes with the front part of the beam. This final phase is illustrated in FIG. 6 (C). The positioning beam is again in the deformation condition of FIG. 6 (A) with a near complete rotation.

Figure 7:
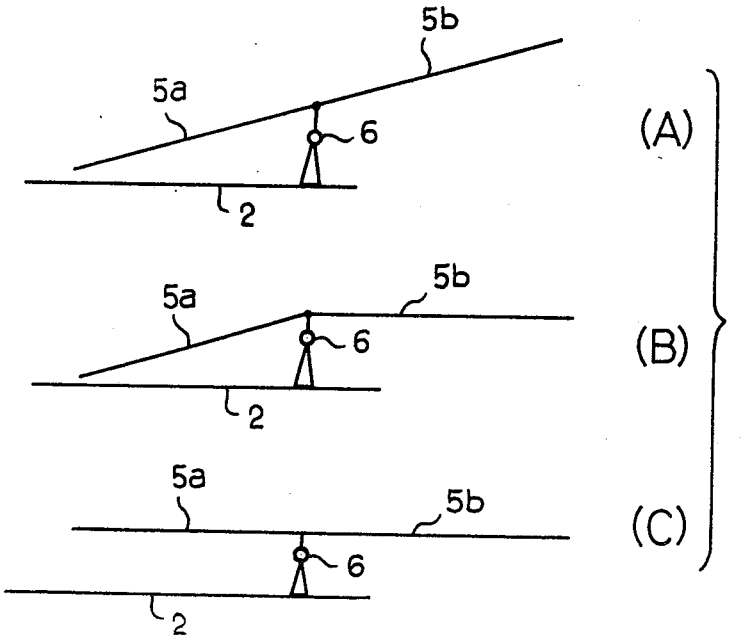
FIG. 7 is a diagram similar to that of FIG. 6, but assuming an initial configuration which differs from that of FIG. 6.

The beam is not necessarily horizontal at the beginning and FIG. 7 relates to an example in which the beam is initially inclined upwards. It is assumed that its complete rotation causes it to take up its final position in which it is substantially horizontal.

If appropriate, during the loading phase of the beam and with the objective of relieving the strain thereof, the swinging movement of the overhanging part is restricted using a support and this support is removed at a given time in the second phase, during which the prestress is produced. For example, if the performances of the beam are to be increased, for example, by positioning one or more additional segments, the weights of which added to those of the segments which have already been provided would result in an inadmissible load for the beam, the beam is provided with a crutch 21 (FIG. 8) at its front end and the crutch is supported on the bridge or on a provisional support 22. The additional segment or segments are introduced. The crutch is loaded and relieves the strain of the positioning beam. All of the segments are then prestressed, as described above. At a determined time during the tensioning operation, the front crutch is released.

I claim:

1. A method of positioning deck segments in the extension of a portion of a deck of a bridge or similar structure using a cable stayed beam resting on a rear support and on a hinged front support, which comprises a first phase during which the overhanging segments are suspended from said beam and the part of the beam which is in front of the front support is maintained substantially steady, and which comprises a second phase, during which the segments are joined to said portion by producing a prestress in the segments and in said portion, and the weight of the segments is progressively transferred to said portion substantially simultaneously with the application of the prestress, which is obtained by progressively allowing the said rear part of the beam to swing around the front support during said second phase.

2. A method according to claim 1, characterised in that one or more jacks are used to control the swinging movement of the rear part of the beam during the second phase.

3. A method according to claim 2, characterised in that the control of these jacks is put under the control of jacks used for the production of the prestress.

4. A method according to claim 1, characterised in that the part of the beam which is behind the front support substantially undergoes a pivoting movement about the front hinged support during the first phase.

5. A method according to claim 4, characterised in that the beam, between its state preceding being loaded with the segments and the final state after the complete transfer of the load to the floor has only undergone one complete swinging movement around the front support.

6. A method according to claim 1, characterised in that during the loading phase of the beam and with the objective of relieving the strain thereof, the swinging movement of the overhanging part is restricted using a support and this support is removed at a given time during the second phase.

7. A device for the implementation of a method according to claim 1, characterised in that it comprises a jack or jacks, by means of which the rear part of the beam is supported.

8. A device according to claim 7 and which comprises jacks to produce the prestress, characterised in that it comprises means for putting these jacks under the control of the jacks of the rear support of the beam.

* * * * *